US005590502A

United States Patent [19]

Wendt

[11] Patent Number: 5,590,502

[45] Date of Patent: Jan. 7, 1997

[54] PANEL ACCESS CLIP FOR RELOCATABLE PARTITIONS

[75] Inventor: Alan C. Wendt, Barrington, Ill.

[73] Assignee: USG Interiors, Inc., Chicago, Ill.

[21] Appl. No.: 398,512

[22] Filed: Feb. 28, 1995

[51] Int. Cl.[6] ..... F04B 2/30

[52] U.S. Cl. ..... 52/489.2; 52/489.1; 52/481.1; 52/281

[58] Field of Search ..... 52/489.1, 489.2, 52/281, 481.2, 712

[56] References Cited

U.S. PATENT DOCUMENTS

| | | | |
|---|---|---|---|
| 3,144,733 | 8/1964 | Balinski | 52/489.1 X |
| 3,187,389 | 6/1965 | Anderson | 52/489.1 |
| 4,187,658 | 2/1980 | Reinwall, Jr. | 52/489.1 |
| 4,272,938 | 6/1981 | Seipos | 52/489.2 X |
| 4,442,642 | 4/1984 | Lindner et al. | 52/498.1 X |
| 5,408,796 | 4/1995 | Hashimoto et al. | 52/489.2 |

OTHER PUBLICATIONS

UW Panel Access Clip, Part No. 9319–0000 (Designed and manufactured by Applicant).

Donn High Performance Clip No. 8420.

*Primary Examiner*—Carl D. Friedman

*Assistant Examiner*—W. Glenn Edwards

*Attorney, Agent, or Firm*—Lee, Mann, Smith, McWilliams, Sweeney & Ohlson

[57] ABSTRACT

A panel access clip for relocatable partitions having a snap-engageable part struck-up from a base portion over a central cut-out and joining said base portion at a flexure zone spaced inwardly from a panel engaging portion of the clip, whereby to reduce shear forces on the panel edge and locate the point of bending flexure during engagement and disengagement with a support member to a zone spaced at least one-half the width of the clip from said panel engaging portion. The clip being capable of allowing engaged panels to be removed from a wall partition assembly without damage to the edges of the panel, whether they are kerfed or non-kerfed panels.

29 Claims, 3 Drawing Sheets

PANEL ACCESS CLIP FOR RELOCATABLE PARTITIONS

BACKGROUND OF THE INVENTION

The invention generally relates to clips for mounting wall panels to a framework. More specifically, the invention is directed toward a resilient clip for removably mounting panels in a wall system. With more particularity, the invention is directed toward a resilient framework-engaging clip engageable to marginal edges of wall panels for removably attaching them to the framework. With further specificity, the invention is related to the foregoing type of resilient clip wherein the flexure point of the clip is spaced away a substantial distance from the marginal edge to avoid breakage during the mounting and dismounting of a panel to and from a framework, respectively.

Prior art wall systems seeking to afford accessibility behind wall panels have allowed for resilient attachment of the panels by means of snap-engageable clips that usually snap-over flanges of the vertical supporting framework members. Cavities behind the wall panels often require accessibility in order to install, modify, or maintain electrical wire, communication lines or plumbing facilities. It is desirable for a panel attachment clip to permit easy access without disturbing the framework, or breaking the panel edge. Additionally, this last mentioned feature would make it possible to achieve accessibility by removing and replacing complete panels with other panels, but without harming the removed panels, so that they might be used in other locations. At the same time, it is necessary to securably lock the panels to the framework in a resilient but tight engagement for providing a rigid, stabile panel system.

Versatility has also been a challenge in the prior art, whereby wall systems may be quickly modified without reconstruction to meet changing space requirements. It would, therefore, be desirable to dismantle and move an entire wall, or just a portion of it, so that redesign can take place. This may be of particular benefit in schools, recreational, community and civic center type of venues where ever-changing needs require modifications to wall systems. Providing a snap-engaging panel clip that allows for the panel to be removed without harming the panel edges would allow for panels to be used in different locations over and over again without the need to buy new panels. Many wall system panels have kerfed edges for insertion of mounting clips. Numerous prior art wall panel clips are designed to harmfully focus the point of flexure and shear force, close to and along the marginal edges, which almost inevitably result in the breakage of the kerfed panel edges. Panel clips have been provided for these kerfed panels wherein flanges of the clips frictionally fit within the marginal kerfs, or are otherwise designed for use with non-kerfed edges and have impaling prongs which imbed within the edges of the wall panels. The wall panels envisioned for use with the present invention are typically made of gypsum wallboard construction well known to the industry.

It is, therefore, a goal of the invention to provide a clip which may snap-engage to the flanges of a supporting frame member and be capable of distributing force panel-edge-inwardly away from the edge and over a sufficient area of distribution whereby partition panels may be pulled outwardly and demounted from a supporting framework without damage.

It is accordingly an allied goal of the invention to provide a resiliently engaging panel clip that includes a snap-engaging portion that is struck-up from a base portion of the clip and has flange-engaging portions that are substantially forward of a line or zone of clip flexure, i.e. toward the panel edge.

Another object of the invention is to provide a framework-engaging clip that may be usable with kerfed-edge panels, or alternately have means for impaling the marginal edges of non-kerfed panels. A concomitant goal in engaging kerfed-edge panels is the formation of frictional-engaging dimples struck-up along the panel-engaging flange of the clip for attaining a snug, secure attachment inside the panel kerf.

It is also a target of the invention to provide a resilient clip having a wide base portion for the distribution of shear and bending forces, and be formed with rigidifying ribs, or embossments, that are laterally offset from, but adjacent to, a framework-engaging part of the clip.

SUMMARY OF THE INVENTION

The invention comprises a resiliently engageable panel clip having a flange for engaging the side edge of a panel generally along the centerline thereof and being integrally formed with a base portion for flush abutment against the backside of a panel. The base portion includes a struck-up snap-engaging portion having a snap-engageable tongue with a free end thereof spaced above the base portion for engagement to flanges of a partition assembly framework. The tongue is flexibly joined to a rebent flange extending upwardly from the base portion and being flexibly joined to the base portion at a zone located rearwardly from the panel edge and at a substantial distance from the tongue. The base portion includes a cut-out located forwardly of the snap-engageable portion, whereby the line of flexure during engagement or disengagement of the clip is spaced a substantial distance away from the edge of the panel to avoid damage during removal of the panel from the framework. It is envisioned that for use with gypsum wall panels in the standard size ranges of ½, ⅝ or ¾ inch thick, clips will be positioned near the top and bottom of the panel, and generally spaced 18 inches on center therebetween.

The edge-engaging flange of the clip further includes struck-up dimples having a half-shell rounded shape and a semi-circular back edge for frictional engagement within the kerfed edge of the panel. Alternately, the edge-engaging flange may be modified to provide a multiplicity of pointed impaling prongs for engagement generally into the center of the edge of a non-kerfed panel.

To further distribute force across the backside of a panel to facilitate removal of the panel without harm, the panel clip is envisioned as having a width sufficient to move the flexure point substantially further than in prior art panel systems. In satisfaction of the above goals, the clip also includes struck-up reinforcing ribs on the base portion to be laterally spaced to either side of the snap-engaging portion. A central cut-out in the base portion is formed by stamping-out and cutting the snap-engagement portion. The cut-out is additionally made to comprise rearwardly extending slots provided to aid in locating the zone(s) of flexure substantially rearwardly of a snap-engaging tongue of the snap-engaging portion. The snap-engaging portion is preferably located between the rearwardly extending slots, centrally over the cut-out of the base portion, and equidistantly terminating at the ends of the slots for locating said flexure zone(s) generally at the terminations of the slots and the central cut-out. The struck-up reinforcing ribs are parallel to and straddle the elongate slots for part of their lengths, thereby rigidifying the base portion so that, during engagement or disengagement of the clip with a framework member, the base portion firmly presses against the back of the panel to distribute shearing forces evenly and placing the line of bending flexure of the clip generally at a location that is greater than half-way along the clip as taken from the edge of the panel.

DETAILED DESCRIPTION OF THE INVENTION

Figure 1:
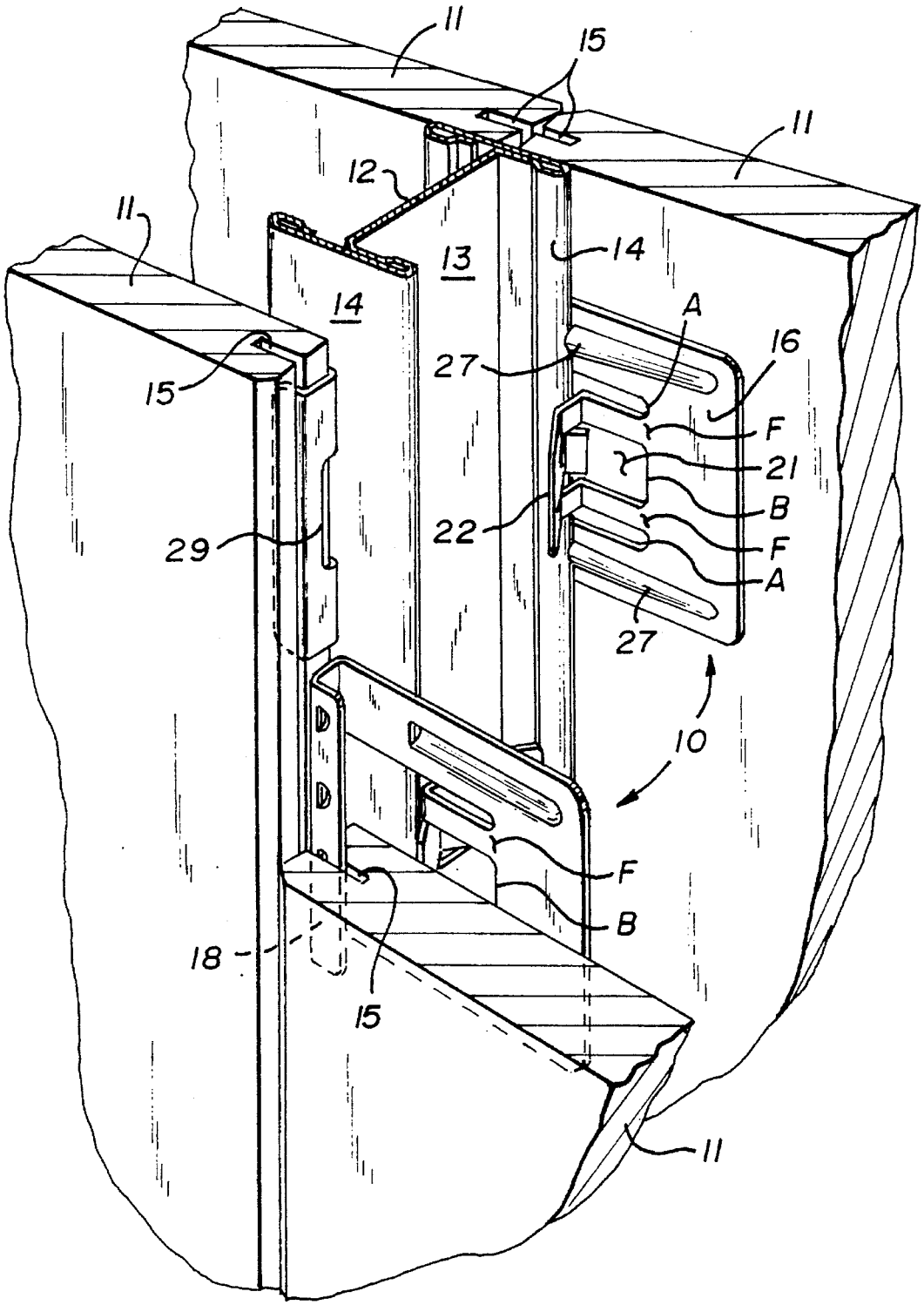
FIG. 1 is a perspective view of a wall partition assembly joint having an upstanding framework supporting member engaged by resilient clips in accordance with the invention, wherein said clips are engaged into kerfed edges of wall panels, a portion of said joint being cut away to show the front and back of the panel engagements of the clips at opposite sides of the framework member.

The invention will now be described in greater detail and in reference to the above-described figures wherein like reference numerals refer to the same elements throughout.

The invention will be more clearly understood by keeping in mind the stated goal of moving the point of bending or flexure to be spaced at a substantial distance from the edge of the panel, whether the panel be kerfed or smooth edged. Thereby, the snap-engagement of the inventive clip transfers bending flexure and shear forces during engagement, or disengagement with flanges of vertical support members, at a distance of at least one-half of the width of the clip from the panel edge. As an example, for a ¾" gypsum panel, the flexure point may be at about 1–1⅛ inches from the panel edge. This structural relationship of the snap-engageable portion of the clip and the base, which flushly presses against the back of the panel, now will be more specifically described in connection with a preferred embodiment of the clip generally denoted at reference numeral 10.

A panel assembly joint is illustrated in the perspective view of FIG. 1. FIG. 1 will be understood as comprising a joint of a typical panel assembly where two panels abut edgewise at either side of a vertical support member defining a cavity therebetween in a known way. In more detail, the panels are denoted at reference numerals 11 and supported by a vertical frame member 12. The vertical frame member 12 is a generally H-shape, comprising a central web 13 integrally meeting pairs of clip engageable flanges 14. The clip 10, in a first embodiment, will be described in connection with the panels 11, which are of the type that are kerfed for receipt of flanges of panel clips therein. Specifically, the panels 11 have elongate centered-edge kerfs 15 cut therein generally at a depth of about ⅜ to ½ inch for a standard ¾ inch gypsum panel embodied by the panels 11. Usual thicknesses for gypsum panels fall in the range of from ½ to ¾ inch, although the ¾ inch panel is the one most commonly kerfed because of the reduction in the thickness by kerfing the edge.

A panel clip 10 in FIG. 1 is attached to each of the four panels 11 and they engage separate arms of the flanges 14 as shown.

Figure 2:
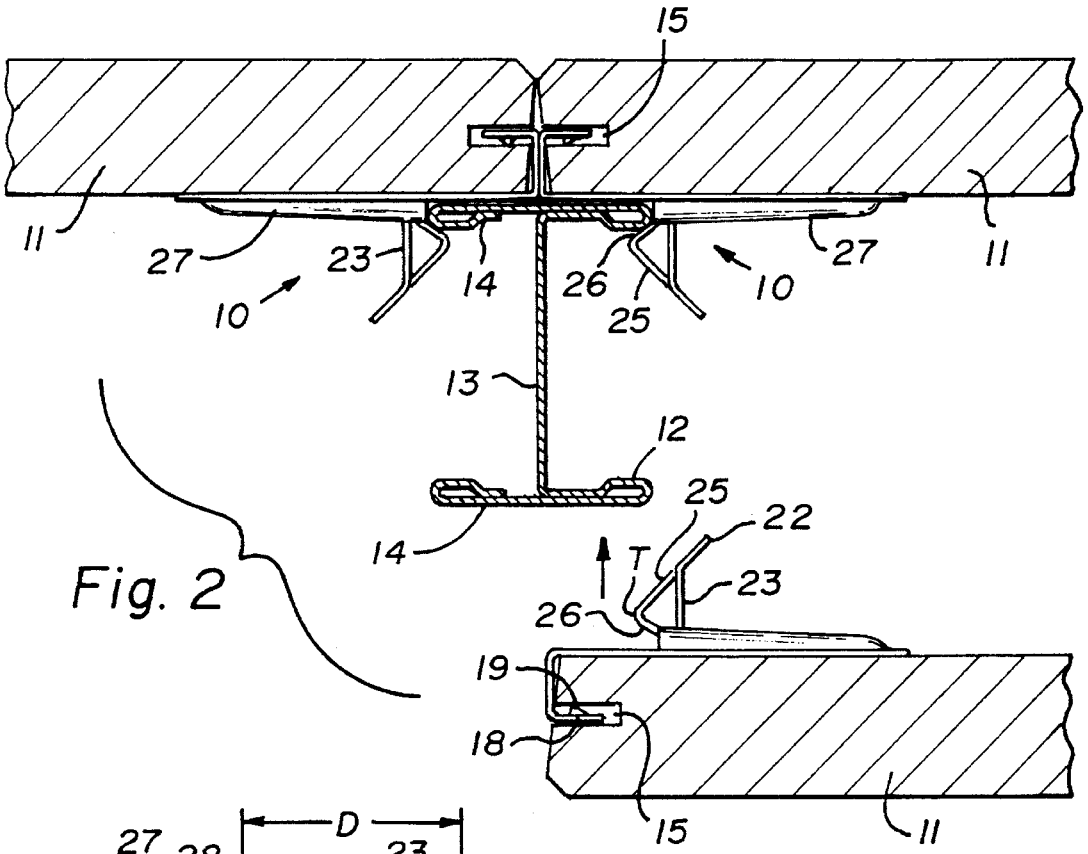
FIG. 2 is a horizontal sectional view at a joint as in FIG. 1 showing at one side two edge-to-edge adjacent panels being engaged to the flanges of a vertical frame member at the snap-engaging portions of respective clips and showing at the other side a clip engaging a panel ready to be snap-engaged to the flange of the vertical frame member at the side of the wall opposite the said two edge-to-edge adjacent panels.
Figure 3:
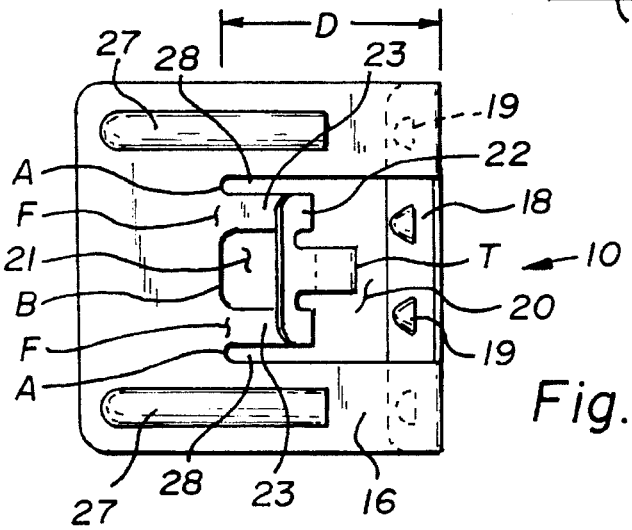
FIG. 3 is a plan view of the resilient clip.

With reference now to FIGS. 2–5, the panel clip 10 will be seen as comprising a generally planar base portion 16, which is generally square, measuring 2×2 inches in the exemplary embodiment. The base portion 16 is integrally joined to a panel edge-overlapping web 17 that terminates in an integrally formed kerf-engaging flange 18. Flange 18 is of sufficient length to project inwardly of the kerf 15 for slightly less than the depth of the kerf, as shown in the cross-sectional view of FIG. 2. In the disclosed embodiment, it has a projecting length of about 5/16 of an inch and the kerf is about 7/16 inch deep. A plurality of struck-up dimples 19 are provided along the flange 18 to offer frictional retention within the kerfs 15. As shown in FIG. 3, the dimples have a generally quarter-spheric, or half-shell, shape with the rounded portion entering the kerf first and the open side providing a sharp curved edge for frictional kerf engagement to facilitate the tight retention of the clip 10 within the kerfs 15.

The base 16 has a cut-out central opening 20 with a narrower rearward cut-out opening 21, as shown in FIG. 3. Struck-up from the base portion 16, and formed by standard metal stamping techniques, is an angled snap-engageable flap 22 that is provided for engagement with the flanges 14 of the vertical frame member 13. The snap-engageable flap 22 is joined to a pair of arms 23, which integrally meet the base portion 16 and have a generally L-shape when viewed from the side. The arms 23 provide flexible connection between the snap-engageable flap 22 and the base portion 16. The arms 23 are the lateral boundaries of the rearward opening 21. A panel-rearward boundary of opening 21 is edge B, as shown in FIG. 3, the details of which will be further described hereinafter. The snap-engageable flap 22 further includes vertical cut-out slots 24 spaced parallel and inwardly of the arms 23. A centrally-depending snap-engageable tongue 25 extends downwardly from the flap 22 between the arms 23 and terminates at bend T in a rebent flange-like snap-over terminus 26. In FIG. 2, it will be seen that a panel 11 is shown ready to be engaged to the flange 14 of the vertical frame member 12, as shown by the arrow. The snap-engagement of the flap 22 is made by the contact of the tongue 25, which is in a skewed relationship to the arm 23 generally at about 45° in the preferred embodiment, against the flange 14 whereby it flexes and is followed by the snap-over of the bend T and thence the terminus 26 over the flange 14 to achieve a full engagement therebehind, as shown at the other two engaged panels 11 of FIG. 2. It will be observed that the spacing of the bend T from the boundary edge B is greater than bend T is spaced from the kerf 15.

Figure 5:
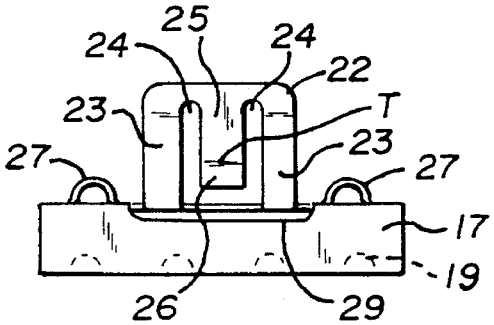
FIG. 5 is an end elevational view of the resilient clip.

During engagement or disengagement, prior art access panel clips have not succeeded in preventing damage to the kerfed edges of the panels. The reason is that the line of flexure and focus of shear force is too close to the kerf 15, which inherently is weaker because of the reduced thickness. In focusing these forces near the kerf, the panels suffer edge damage 90% to 100% of the time. The present inventive panel clip overcomes this problem by configuring the rearward cut-out 21 to dispose edge B at a distance no less than ½ of the width of the panel clip from the web 17 and greater than the thickness dimension of the panel 11. In addition, the base portion 16 is further provided with deeply cut parallel slots 28, which extend alongside the arms 23 and terminate at rearward ends A, as shown in FIG. 3. Preferably, the ends A of the slots 28 and the back edge B of the rearward cut-out 21 are spaced at about the same distance inwardly from the panel-engaging edge of the clip, for example, in the disclosed embodiment for use with a ¾ inch panel, they are spaced at about 1.2 inches inwardly from web 17, although they could be at different spacings. In this way, two flexure zones F are provided at the engagement of the arms 23 to the base 16. The zones F represent the place of flexure across the base 16 for the struck-up snap-engageable flap 22. All parts 23, 25, 26, of the snap-engageable portion 22 are flexibly spaced forwardly of the zones F and are freely positioned at or above cut-outs 20, 21, as shown in FIGS. 1, 3 and 5.

Figure 4:
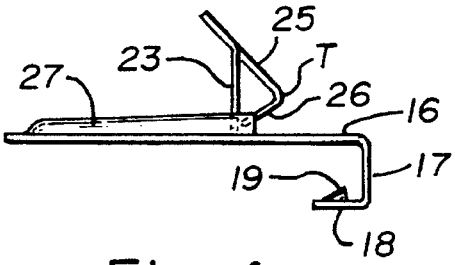
FIG. 4 is a side elevational view of the resilient clip.

Except for the upstanding parts of the flap 22 and a pair of ribs 27, described below, the portions of the base portion 16 extending rearwardly from the web 17 to rearwardly of the flexure zones F are in flush contact with the back of the panel 11, as shown in FIG. 2. The configuration of the base portion 16 relative to the flap 22, the provision of base portion 16 panel-contact area behind zones F, the rearward opening 21, the relative size of the clip 16 to the panel thickness, all combine to distribute shear force and bending flexure over a wide area and away from the panel edge kerfs 15. To provide a sturdy and firm structure for making the engagements and disengagements with the vertical members 12, the base portion 16 is further provided with a pair of elongate ribs or embossments 27, which extend parallel to each other and laterally of the elongate slots 28, best viewed in FIG. 3. The embossments 27 are ridge-like and slightly tapered from the front to rear, as shown in FIG. 4. In cross-section, they have a generally semi-circular shape, as shown in FIG. 5, and offer a reinforcement to the otherwise generally planar base portion 16. As shown in FIG. 3, they extend both forwardly and rearwardly of the flexure zones F and the ends A of slots 28. The embossments 27 stiffen the base portion 16 adjacent the region of flexure in the zones F and effectively prevent bending or warping of the planar base portion 16. In the disclosed embodiment, the panel clip 10 is a metal stamping made of spring steel having a thickness of about 0.018 inches. The height of the reinforcement ribs, or embossments, 27 are approximately 0.125 inches at their forward edges, as shown in FIG. 5, and taper rearwardly to a height of about 0.080 inches, as shown in the side elevational view of FIG. 4.

The panel clip 10 also is provided with a front cut-out notch across the web 17, generally denoted at 29, which is an extension of the cut-out opening 20. In that way, the notch 29 spaces the central part of the web 17 below the surface of the panel 11, and thereby eliminates any sharp metal edge that might otherwise harmfully chafe against the corner edge of the panel, such as while the snap-engageable flap 22 flexes during engagement and disengagement. To either side of the notch 29, the base portion 16 and web 17 generally overlap the edge of the panel and harmlessly transfer the forces backwardly away from the panel edge to, and rearward of, the flexure zones F, and also to the reinforcement ribs 27.

In the preferred embodiment, the cut-out 20 has a height measured parallel to the web 17 of about one-half of the height of the panel clip 10. Accordingly, for the 2×2 inch square of the exemplary embodiment, ½ inch of the base portion 16 extends above and below the cut-out 20. Therefore, the notch 29 also has a length of about one-half of the height of the panel clip. Additionally seen in FIG. 3, a dimension D is 1.20 inches, which is the distance that the terminii A and B of the slots 28 and cut-out 21, respectively, are spaced from the web 17. Accordingly, dimension D defines the general location of the flexure zones F.

Figure 6:
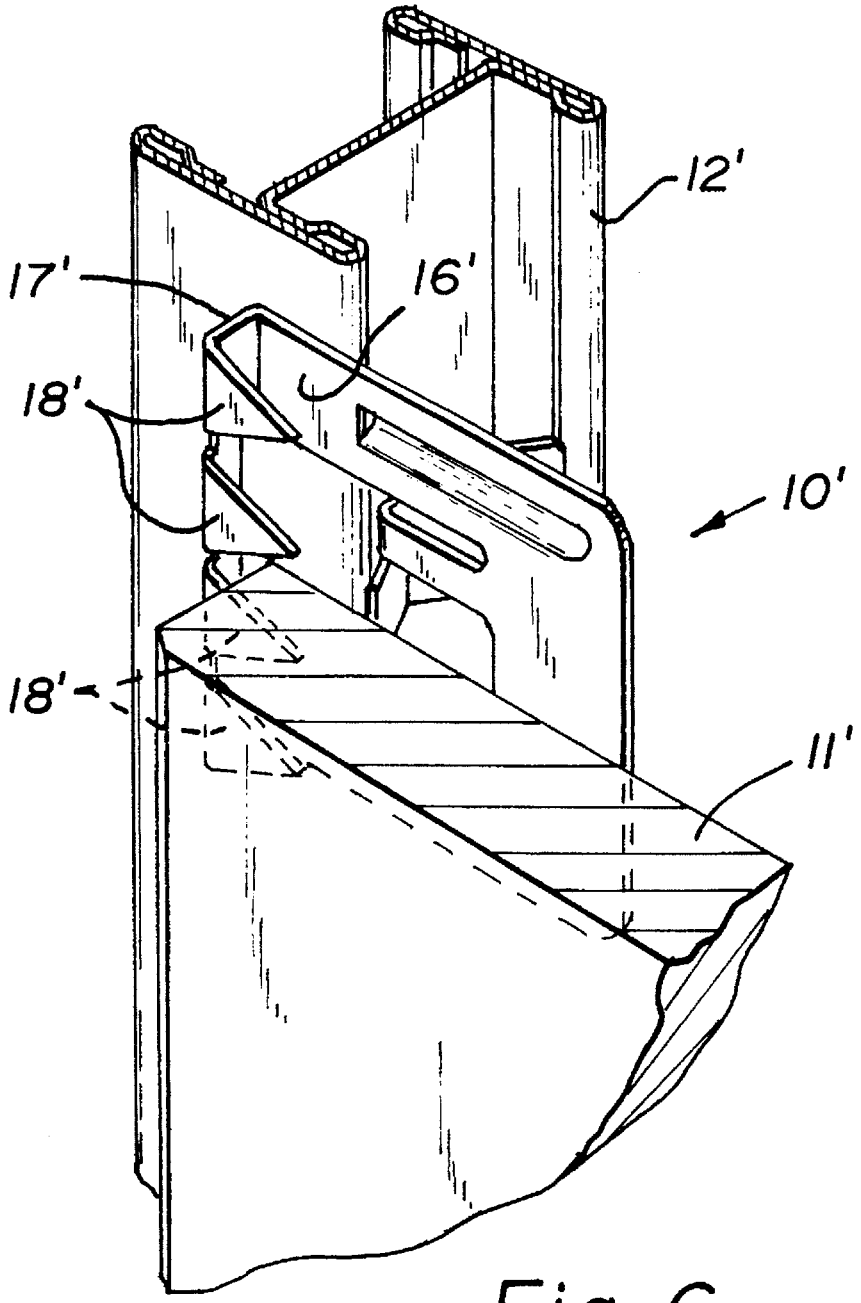
FIG. 6 is a perspective view of a non-kerfed edge panel being engaged by an alternative embodiment of the resilient clip of the invention for mounting to a vertical frame member of a wall panel assembly.

FIG. 6 is one alternate embodiment of the invention showing panel and clip arrangements substantially the same as clips 10 and panels 11, but using prime numbers wherein panel clip 10' is shown engaged to a panel 11' and mounted on a vertical frame member 12'. The panel clip 10' also includes a web 17', but instead of providing a kerf-engaging flange 18, a plurality of impaling prongs 18' are provided for engagement into the edges of the panels 11', which in this embodiment are not kerfed. For kerfed panels, the panel clips 10 can be removed from the panels themselves and placed back at the same or other locations as necessary. In the use of impaling prongs 18', if a panel clip 10' is removed from a panel 11', and it is intended for the panel 11' to be remounted, the panel clip 10' would generally need to be impaled at a new position along the edge to be spaced from the previous impalement punctures. The remaining portions of panel clip 10' and its function and structural characteristics are the same as for panel clip 10.

While the invention has been described in connection with exemplary embodiments, the scope of the invention is not to be limited thereby, and a broad range of equivalents fall within the scope of the claims appended hereto.

What is claimed is:

1. A snap engageable clip for use in wall panel partition assemblies comprising:

a generally planar base portion having means for engaging the edge of a panel, said base portion including a central cut-out and integral rearward cut-out, resiliently engageable means extending upwardly from said base portion and including means for snap-engaging support members of a wall panel partition assembly, said means for a snap-engaging disposed over said central cut-out and rearward cut-out, said base portion further including elongate slots of said central cut-out extending rearwardly of said resiliently engageable means, reinforcing ribs projecting from said base portion laterally of said elongate slots, and said base portion including a planar portion rearwardly of said elongate slots and rearward cut-out.

2. A panel access clip for relocatable wall panels of wall partition assemblies comprising:

an integrally formed metal stamping having a base portion, means for engaging the edge of a panel, resilient engaging means flexibly joined to the base portion and including means for snapping-over engageable means of wall partition frame members, a central portion cut-out of said base portion, said base portion including elongate slots extending rearwardly of said resilient engaging means, and said resilient engaging means joined to said base portion at a zone of flexure spaced no less than about one-half the width of the clip from said means for engaging the edge of a panel.

3. A panel access clip as claimed in claim 2 wherein said base portion extends rearwardly of said means for snapping-over engageable means of wall partition frame members.

4. A panel access clip as claimed in claim 2 wherein said base portion extends rearwardly of said central portion cut-out of said base portion.

5. A panel access clip as claimed in claim 2 wherein said means for engaging the edge of a panel comprises a panel kerf-engageable flange.

6. A panel access clip as claimed in claim 5 wherein said flange includes struck-up dimples.

7. A panel access clip as claimed in claim 2 wherein said means for engaging the edge of the panel comprise a plurality of impaling prongs.

8. A panel access clip as claimed in claim 2 wherein said base portion includes reinforcing ribs spaced laterally of said central portion cut-out of said base portion and extending rearwardly of said resilient engaging means.

9. A panel access clip as claimed in claim 8 wherein said ribs taper in height.

10. A panel access clip as claimed in claim 2 wherein said base portion includes reinforcing ribs spaced parallel to said elongate slots, wherein said elongate slots extend for part of the lengths of the reinforcing ribs and rearwardly of said resilient engaging means.

11. A panel access clip as claimed in claim 2 wherein said resilient engaging means is struck-up from said base portion and said means for snapping-over engageable means of wall partition frame members includes a flap and an integrally formed resilient depending tongue for snapping-over wall partition frame members.

12. A panel access clip as claimed in claim 11 wherein said resilient engaging means is flexibly joined to the base portion generally equidistant to a rear edge of said central portion cut-out of said base portion.

13. A panel access clip as claimed in claim 12 wherein said central portion cut-out of said base portion includes elongate slots extending rearwardly of the resilient engaging means.

14. A panel access clip as claimed in claim 2 wherein said central portion cut-out of said base portion has a height of about one-half the height of said clip.

15. A wall partition assembly comprising a plurality of wall panels having panel clips engaged thereof and said panel clips being resiliently engaged to framework support members, said panel clips comprising a base portion having a central cut-out, said central cut-out portion including rearwardly extending elongate slots, said panel clips further having a snap-engaging part extending generally at and above said central cut-out and joined to said base portion at means for flexing said snap-engaging part relative to said base portion, said base portion having means for engaging edges of said wall panels, and said means for flexing being spaced from said means for engaging at a distance no less than about one-half the width of the clip.

16. A wall partition assembly as claimed in claim 15 wherein said base portion extends rearwardly of said snap-engaging part.

17. A wall partition assembly as claimed in claim 15 wherein said base portion extends rearwardly of said central cut-out.

18. A wall partition assembly as claimed in claim 15 wherein said means for engaging edges of wall panels comprises a panel kerf-engageable flange.

19. A wall partition assembly as claimed in claim 18 wherein said flange includes struck-up dimples.

20. A wall partition assembly as claimed in claim 15 wherein said means for engaging the edges of wall panels comprise a plurality of impaling prongs.

21. A wall partition assembly as claimed in claim 15 wherein said base portion includes reinforcing ribs spaced laterally of said central cut-out and extending rearwardly of said snap-engaging part.

22. A wall partition assembly as claimed in claim 21 wherein said ribs taper in height.

23. A wall partition assembly as claimed in claim 15 wherein said central cut-out includes elongate slots extending rearwardly of said snap-engaging part.

24. A wall partition assembly as claimed in claim 23 wherein said base portion includes reinforcing ribs spaced parallel to said elongate slots, wherein said elongate slots extend for part of the lengths of the reinforcing ribs and rearwardly of said snap-engaging part.

25. A wall partition assembly as claimed in claim 15 wherein said snap-engaging part is struck-up from said base portion and said snap-engaging part includes a flap and an integrally formed resilient depending tongue for snapping-over wall partition frame members.

26. A wall partition assembly as claimed in claim 25 wherein said means for flexing said snap-engaging part relative to said base portion being generally equidistant to a rear edge of said central cut-out of said base portion.

27. A wall partition assembly as claimed in claim 26 wherein said central cut-out of said base portion includes elongate slots extending rearwardly of the snap-engaging part.

28. A wall partition assembly as claimed in claim 15 wherein said central cut-out of said base portion has a height of about one-half the height of said clip.

29. A panel clip as claimed in claim 1 wherein said reinforcing ribs include forward edges perpendicular in height to said base portion.

* * * * *